US008047335B2

(12) United States Patent
Fargo et al.

(10) Patent No.: US 8,047,335 B2
(45) Date of Patent: Nov. 1, 2011

(54) SHOCK ABSORBING HITCH

(75) Inventors: Richard Fargo, Plainville, CT (US); Richard L. Hollowell, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 1588 days.

(21) Appl. No.: 10/564,873

(22) PCT Filed: Aug. 6, 2003

(86) PCT No.: PCT/US03/24542

§ 371 (c)(1),
(2), (4) Date: Jan. 17, 2006

(87) PCT Pub. No.: WO2005/016812

PCT Pub. Date: Feb. 24, 2005

(65) Prior Publication Data

US 2006/0175152 A1 Aug. 10, 2006

(51) Int. Cl.

| | |
|---|---|
| ***B66B 7/10*** | (2006.01) |
| ***B66B 7/08*** | (2006.01) |
| ***B66B 11/08*** | (2006.01) |

(52) U.S. Cl. ..... 187/412; 187/411

(58) Field of Classification Search ..... 187/411, 187/412, 345–347, 264

See application file for complete search history.

(56) References Cited

U.S. PATENT DOCUMENTS

| | | | | |
|---|---|---|---|---|
| 4,537,286 | A | 8/1985 | Morris et al. | |
| 5,307,904 | A * | 5/1994 | Yoo | 187/343 |
| 5,421,433 | A | 6/1995 | Yoo | |
| 5,611,412 | A | 3/1997 | Yoo et al. | |
| 5,750,945 | A * | 5/1998 | Fuller et al. | 187/292 |
| 6,065,569 | A * | 5/2000 | Fuller | 187/345 |
| 6,123,176 | A * | 9/2000 | O'Donnell et al. | 187/393 |
| 6,216,824 | B1 * | 4/2001 | Fuller et al. | 187/292 |
| 6,223,862 | B1 * | 5/2001 | Barnes | 187/412 |
| 6,234,276 | B1 * | 5/2001 | Wagatsuma et al. | 187/411 |
| 6,315,084 | B1 * | 11/2001 | Shon | 187/411 |

FOREIGN PATENT DOCUMENTS

| | | |
|---|---|---|
| CN | 1147474 | 4/1997 |
| JP | 59137431 | 9/1984 |
| JP | 60183483 | 9/1985 |
| JP | 06239570 | 8/1994 |

OTHER PUBLICATIONS

PCT International Search Report relating to International Application No. PCT/US03/24542 dated Jan. 27, 2004.

PCT International Preliminary Examination Report relating to International Application No. PCT/US03/24542, dated Oct. 8, 2004.

* cited by examiner

*Primary Examiner* — Michael Mansen
*Assistant Examiner* — Stefan Kruer
(74) *Attorney, Agent, or Firm* — Carlson, Gaskey & Olds PC

(57) ABSTRACT

A shock-absorbing hitch termination (40) includes a terminating member (52) that moves against a first bias (62) responsive to a first level of tension on a load bearing member (26) associated with a car (22) and counterweight (24) in an elevator system (20). A support member (60) moves with the terminating members (52) against a second, passive bias (70) responsive to increased tension on the load bearing member (26). In one example, the second bias is provided by mechanical springs (70). In another example the second bias is provided by air springs. In still another example the second bias is provided by pressurized actuators (82). The shock-absorbing hitch termination may be supported for movement with the car, counterweight or both. In another example, the shock-absorbing hitch termination is provided in a stationary structure (90) within the elevator system.

14 Claims, 5 Drawing Sheets

SHOCK ABSORBING HITCH

FIELD OF THE INVENTION

This invention generally relates to elevator systems. More particularly, this invention relates to controlling the tension on a load bearing member in an elevator system.

DESCRIPTION OF THE RELATED ART

Elevator systems often include a car and counterweight that move in opposite directions within a hoistway. A load bearing member such as a rope or belt supports the car and counterweight for movement as desired. There are situations where the tension on the load bearing member needs to be controlled within desirable limits to ensure proper traction and to avoid undesirable stress on the system components.

One example situation where there is an undesirably high amount of stress on the rope is during a so-called car or counterweight jump. Car jump occurs when a counterweight rapidly descends and strikes a safety or buffer near a bottom of a hoistway, for example. The ascending car continues to move upward even after the counterweight has hit the safety or bumper. After the kinetic energy of the moving car has dissipated, the car then falls back because of the slack in the rope introduced by the additional upward movement of the car. As the car moves back downward, this causes high stress in the rope, drive machine and other supporting structures of the elevator system. Counterweight jump occurs in a similar manner when the car rapidly descends and strikes a buffer near the bottom of the hoistway or otherwise abruptly stops after a rapid descent.

A conventional approach at minimizing car or counterweight jump is to use tie-down compensation. There are various known tie-down arrangements. While conventional arrangements do assist in minimizing rope slack and preventing the high dynamic stresses otherwise associated with car or counterweight jump, they are not without drawbacks. Hydraulic tie-down arrangements, as an example, are expensive and impose structural requirements on the hoistway pit floor that further introduce cost and labor. Additionally, such arrangements require a minimum pit depth that is larger than desired or available in many situations.

There is a need for better tension control in elevator systems that rely upon tension in a load bearing rope or belt. Additionally, there is always a need to minimize the expenses associated with installing and operating elevator systems. This invention addresses the need for managing tension on the load bearing member in the event of a counterweight or car jump, for example, in a cost-effective manner.

SUMMARY OF THE INVENTION

In general terms, this invention is a shock-absorbing hitch arrangement that absorbs at least some of a load otherwise imposed on a load bearing member in an elevator system during certain situations, such as a car or counterweight jump.

One example system designed according to this invention includes a car and counterweight. A load bearing member supports the car and counterweight such that the car moves in one direction and the counterweight moves in an opposite direction. A termination is associated with at least one end of the load bearing member. At least a portion of the termination moves against a first bias responsive to a tension on the load bearing member that is below a selected threshold. A portion of the termination moves against a second bias responsive to a tension that exceeds the threshold.

In one example, the termination includes a terminating member and a support member. The terminating member moves relative to the support member responsive to the tension that is below the threshold. The support member moves with the terminating member when the tension exceeds the threshold. In one example, the terminating member is a thimble rod.

An example system includes a first biasing member that biases one end of the terminating member away from the support member. A second biasing member biases the support member away from a stationary surface on a chosen structure within the elevator system. The terminating member moves against the bias of the first biasing member responsive to normal loads on the load bearing member within the elevator system. When the tension on the load bearing member exceeds a selected threshold, the support member moves against the bias of the second biasing member responsive to the increased load.

In one example, the first biasing member comprises a coil spring. The second biasing member comprises at least one of a mechanical spring, an air spring, a hydraulic actuator or a pneumatic actuator. The second biasing member preferably is preloaded in one example such that the stiffness of the second biasing member is lower than the stiffness of the first biasing member but the second biasing member does not permit movement of the support member until the coil spring is effectively compressed a desired amount by tension on the load bearing member. The operation of the second biasing member preferably is passive in that it moves responsive to tension on the load bearing member.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
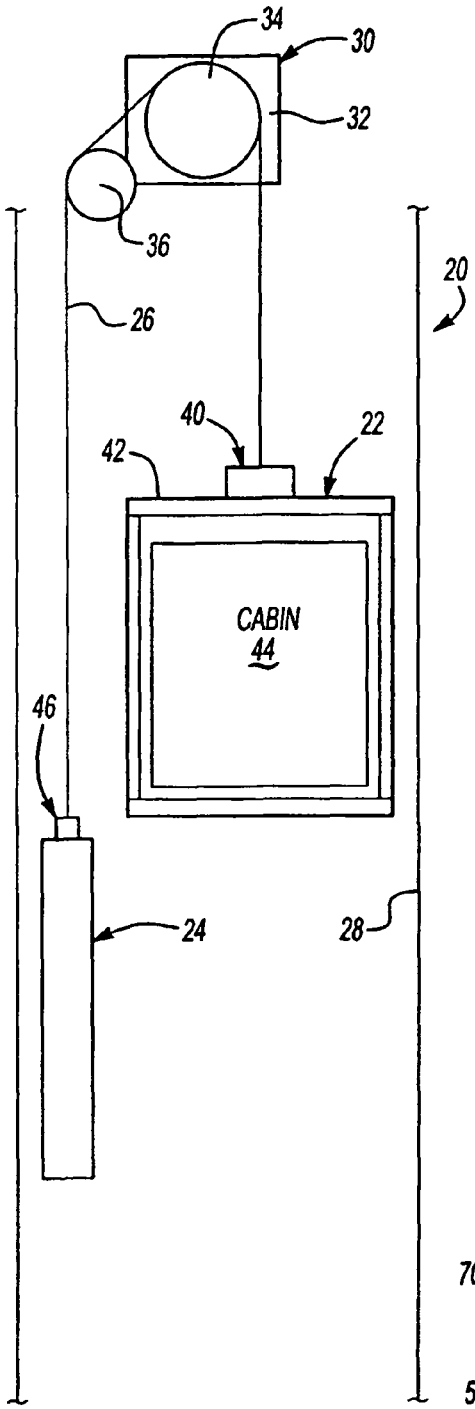
FIG. 1 schematically illustrates an example elevator system designed according to an embodiment of this invention.

FIG. 1 schematically shows an elevator system 20 including a car 22 and counterweight 24. A load bearing member 26 such as a rope or belt supports the car 22 and counterweight 24 for the desired movement within a hoistway 28. A conventional machine 30 includes a motor 32 and drive sheave 34 for causing the desired movement of the car and counterweight within the hoistway in a conventional manner. The illustrated example includes a deflection sheave 36 for guiding the load bearing member 26 as needed.

The load bearing member 26 in this example has one end associated with the car 22 and a second end associated with the counterweight 24. A termination 40 couples one end of the load bearing member 26 to the frame 42 of the car 22. The car in portion 44 of the car 22 is supported by the frame 42 in a conventional manner.

A termination 46 secures the opposite end of the load bearing member 26 to the counterweight 24.

Figure 2:
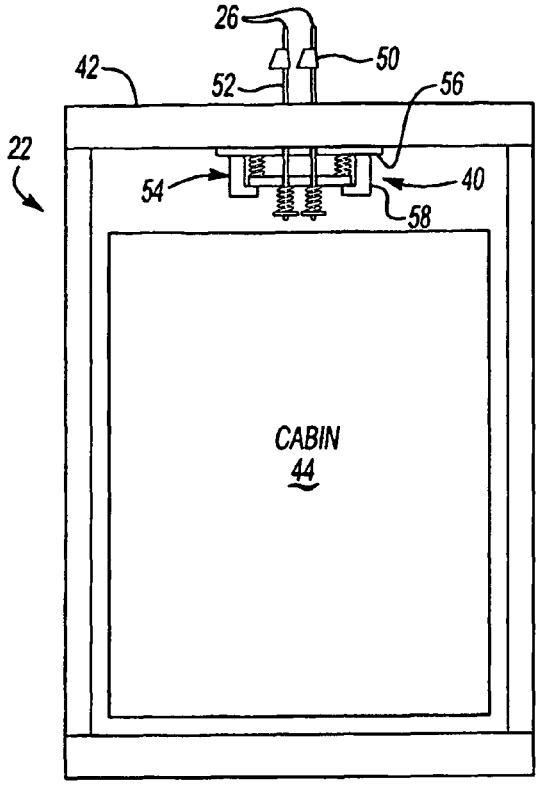
FIG. 2 schematically illustrates an example embodiment of a shock-absorbing hitch supported for movement with an elevator car.
Figure 3:
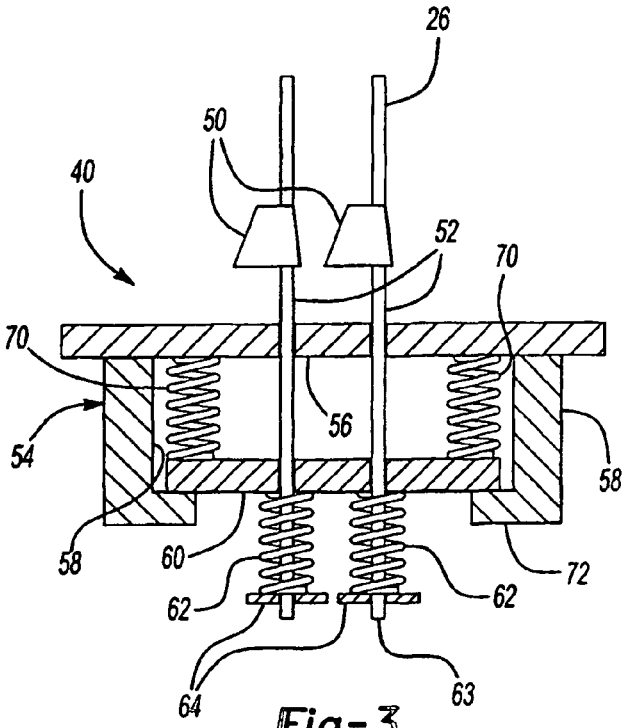
FIG. 3 is a partial cross-sectional view of the shock-absorbing hitch embodiment of FIG. 2.

Referring to FIGS. 2 and 3, an example embodiment of the termination 40, which is a shock-absorbing hitch, is shown. FIG. 2 illustrates the termination 40 supported on the frame 42 of the car 22. Two ropes or belts 26 are shown as an example load bearing arrangement.

The termination 40 includes conventional clamps 50 that secure ends of the load bearing members 26 to terminating members 52, which are thimble rods in this example. Those skilled in the art who have the benefit of this description will be able to select from among known clamping arrangements (i.e., socket and wedge) to meet the needs of their particular situation. The terminating members 52 are movable relative to a guide structure 54. A stationary surface 56 of the guide structure 54 is secured in place to an appropriate portion of the car frame 42. Guide members 58 extend away from the stationary surface 56.

A selectively moveable support member 60 is guided by the guide members 58. In one example, the support member 60 comprises a rigid plate. In the illustrated example, the support member 60 is constrained by the guide members 58 such that it only moves vertically (according to the drawings). A cooperating groove and tab arrangement may be provided to facilitate smooth movement of the support member 60 relative to the guide members 58. Those skilled in the art who have the benefit of this description will be able to choose a suitable arrangement for their particular chosen structure.

A first biasing member 62 biases the distal ends 63 of the thimble rods 52 away from the support member 60. In this example, the first biasing member comprises a plurality of coiled springs 62. In one example, the coil springs 62 comprise conventional hitch springs that operate in a known manner to permit normal control of the tension on the load bearing member in the elevator system and to equalize tension between ropes, for example. Locking members 64 are secured using conventional techniques near the ends 63 of the thimble rods 52. The springs 62 act against one side of the support member 60 at one end and against the locking members 64 at the other end.

The support member 60 is moveable relative to the guide members 58 of the guide structure 54. A second biasing member urges the support member 60 away from the stationary surface 56 into the illustrated position against stop members 72 of the guide structure 54. In this example, the second biasing member comprises a plurality of coiled springs 70.

During normal elevator system operation the support member 60 remains stationary against the stop members 72 because of the bias provided by the second biasing member. In one example, the springs 70 are less stiff than the springs 62. The springs 70 in this example preferably are preloaded such that the springs 62 must be essentially fully compressed by tension on the load bearing member 26 before the support member 60 will move against the bias of the springs 70 toward the stationary surface 56 responsive to increased tension on the load bearing members 26. In one example, the stiffness of the springs 70 is significantly lower than the stiffness of the springs 62.

Figure 4:
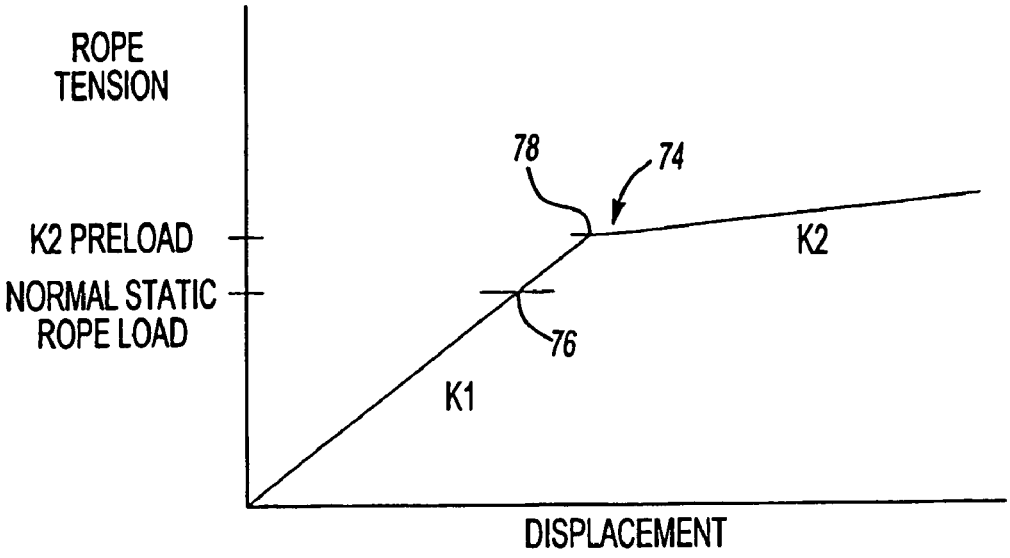
FIG. 4 is a graphical illustration of a performance feature of the embodiment of FIGS. 2 and 3.

FIG. 4 graphically illustrates the performance of an embodiment having a second biasing member with a stiffness that is lower than that of the first biasing member. A plot 74 shows the displacement of the terminating members 52 relative to the stationary surface 56, which remains stationary relative to the car frame 42 in the example of FIG. 2. At a point 76, corresponding to the normal static load on the load bearing members 26, the springs 62 are under compression and provide equalized tension between ropes, for example. When the tension on the load bearing member 26 exceeds a threshold at 78, the springs 62 are compressed a desired amount (i.e., fully compressed in one example) and the springs 70 begin to compress to absorb the increasing load on the load bearing members 26.

One example situation where the springs 70 compress to absorb load on the load bearing members is in the event of a counterweight buffer stop. As the car 22 continues upward and then falls back downward, the tension on the load bearing members 26 exceeds the preload tension K2 on the springs 70, which begins to compress the springs 70 and causes the support member 60 to move toward the stationary surface 56. The springs 70 will compress an amount corresponding to the additional tension. The additional motion of the termination 40 (and more particularly, the additional motion of the terminating members 52 with the support member 60) effectively increases the stopping distance of the falling car. This effectively increased stopping distance limits the peak dynamic load imposed on the load bearing members 26 and corresponding sheave support structure. The shock-absorbing hitch termination 40 absorbs the load of additional tension associated with the fallback of the car.

Figure 5:
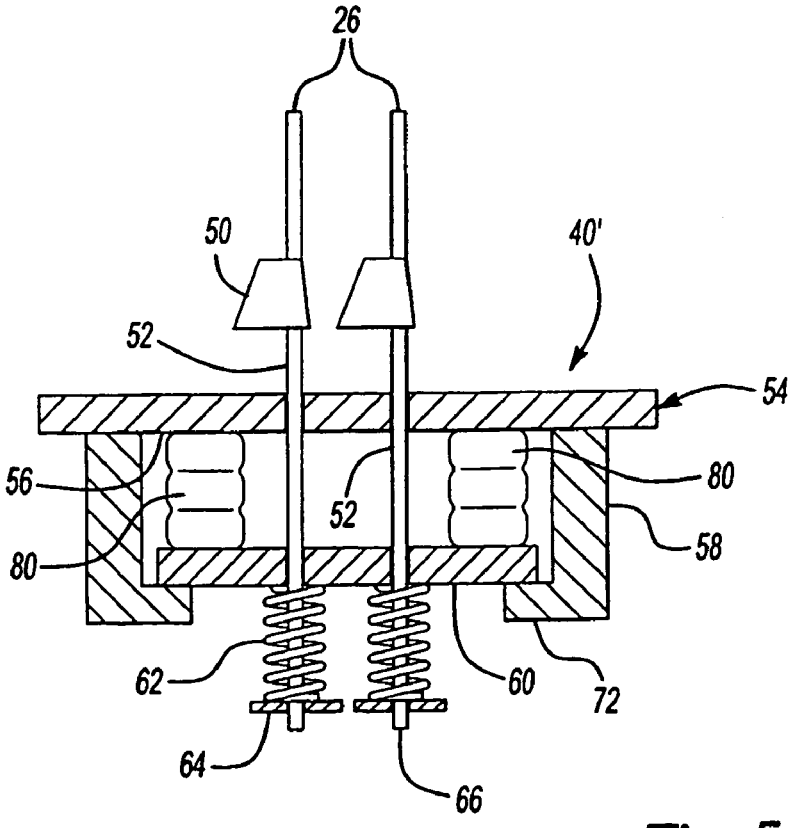
FIG. 5 schematically illustrates an alternative embodiment of a shock-absorbing hitch designed according to this invention.

The previous example included mechanical springs as the second biasing member. FIG. 5 illustrates another example termination 40' where the second biasing member comprises a plurality of air springs 80. The air springs 80 preferably are selected to provide a desired bias to urge the support member 60 against the stop members 72 in a manner similar to the springs 70 of the previous example. Given this description, those skilled in the art will be able to select from among commercially available air spring arrangements to meet the needs of their particular situation.

Figure 6:
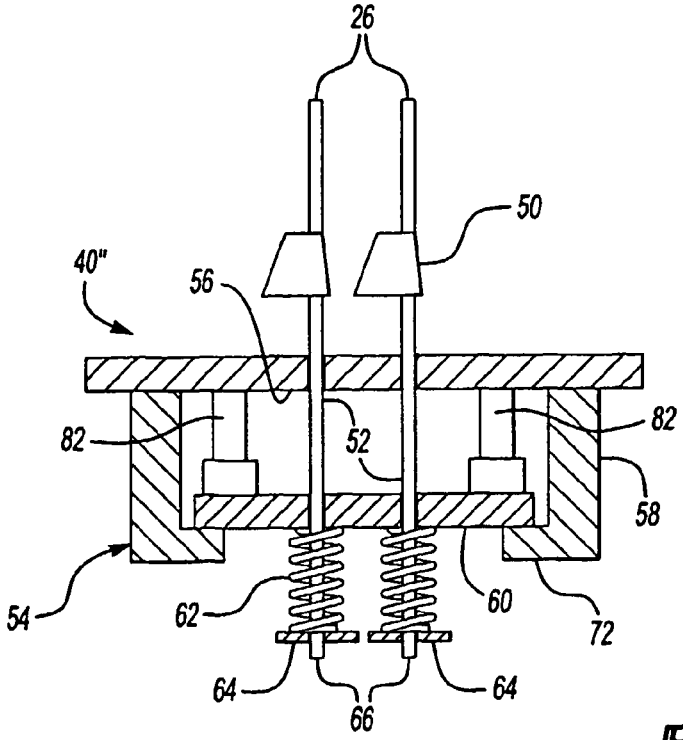
FIG. 6 illustrates another alternative embodiment.

FIG. 6 illustrates another example termination 40" where the second biasing member comprises a plurality of pressurized actuators 82. In one example, the pressurized actuators 82 comprise hydraulic shock-absorbing cylinders. In another example, the pressurized actuators 82 are pneumatic. The second biasing member provides a damping effect allowing selected movement of the support member 60 responsive to increased tension on the load bearing members 26 as described above.

Figure 7:
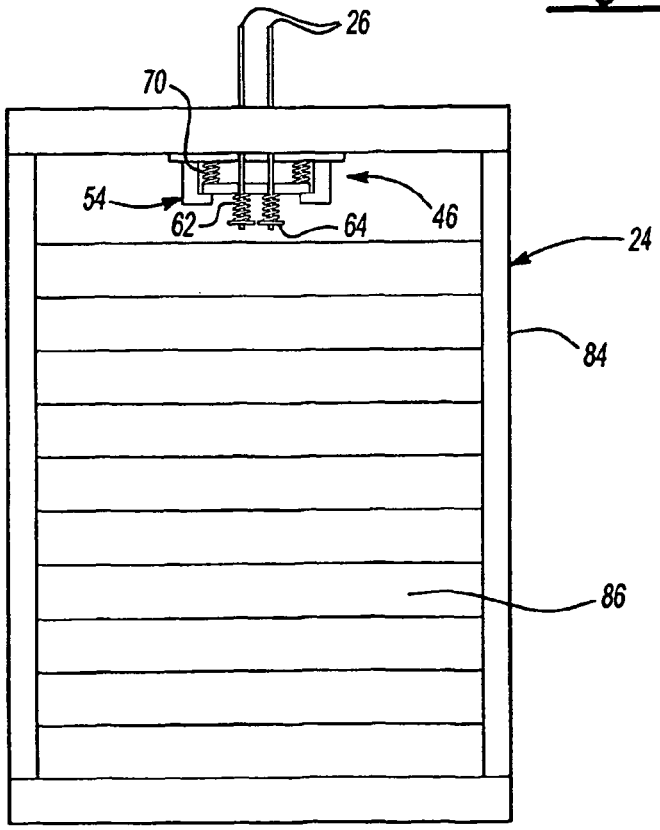
FIG. 7 schematically illustrates a shock-absorbing hitch supported for movement with a counterweight.

In another example arrangement, the shock-absorbing hitch is provided on the counterweight 24. FIG. 7 schematically illustrates an arrangement where the counterweight termination 46 includes the features of the termination 40 from FIG. 3, for example. The guide structure 54 is secured in place to a counterweight frame 84 that also supports counterweight fillers 86 in a conventional manner. The termination 46 operates in the same manner as the termination 40 of FIG. 3, in one example.

One example system designed according to this invention includes a shock-absorbing hitch termination on each of the car and the counterweight. Other example arrangements include such a termination on at least one of the car or counterweight.

Figure 8:
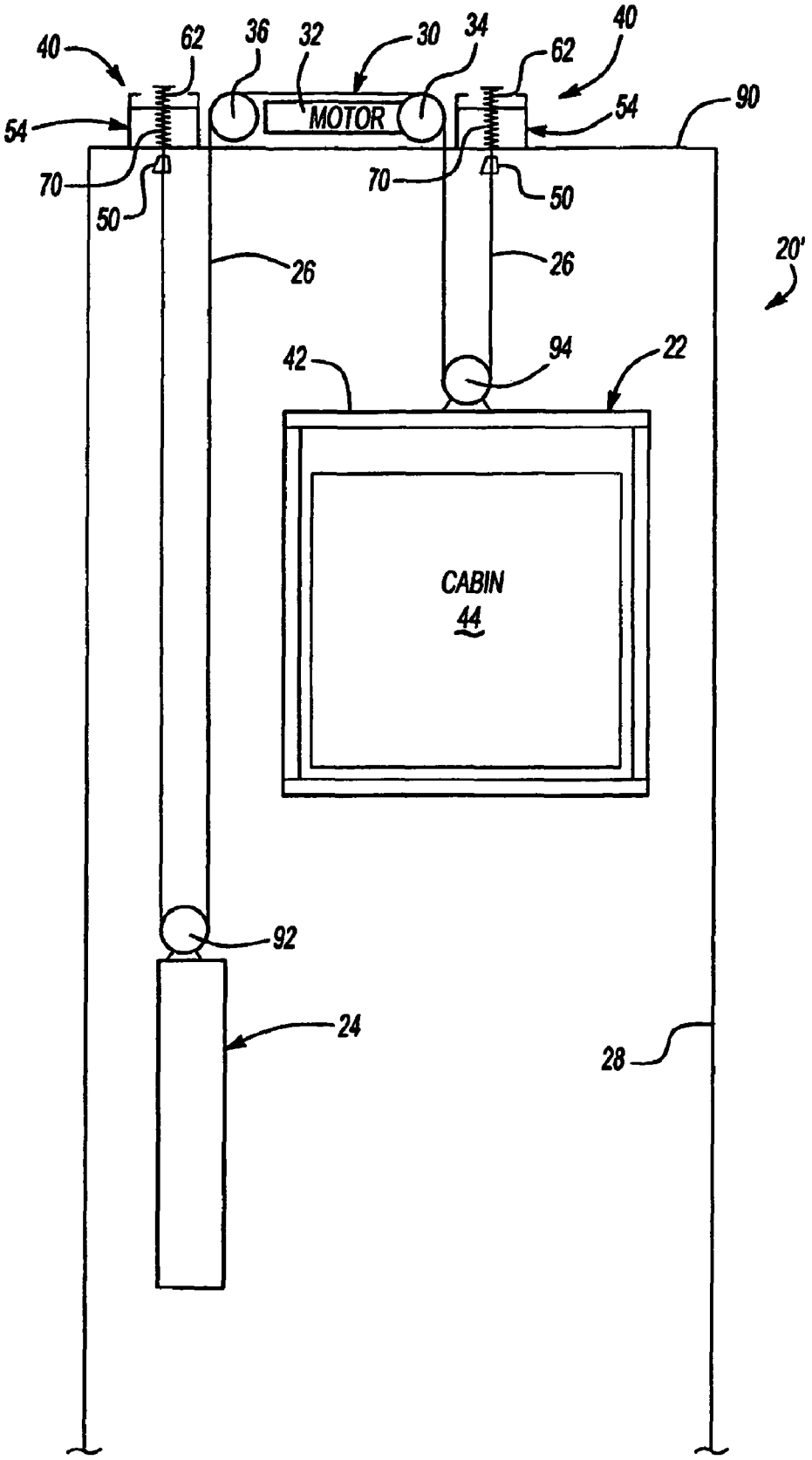
FIG. 8 schematically illustrates another elevator system arrangement designed according to an embodiment of this invention.

FIG. 8 schematically illustrates another example elevator system 20' with which the inventive termination may be used. This example elevator system includes a 2:1 roping arrangement. The shock-absorbing hitch terminations 40 are secured in place on a structural member 90 that also provides support for the machine 30 that is responsible for driving the elevator system. Idle sheaves 92 and 94 are associated with the counterweight 24 and car 22, respectively, in a conventional manner. The ends of the load bearing member 26 are secured in place relative to the structural member 90. At least one termination 40 that responds to increased loads on the load bearing member 26 operates in a manner as described above. In the illustrated example, both ends of the load bearing member 26 are secured using a shock-absorbing hitch termination 40. In another example, at least one of the ends has such a termination while the other end has a conventional termination.

In one example, the termination 40 is supported within a machine room. In another example the termination 40 is supported on an appropriate structure within the hoistway to remain stationary as needed to provide the desired roping arrangement (i.e., 2:1).

Figure 9:
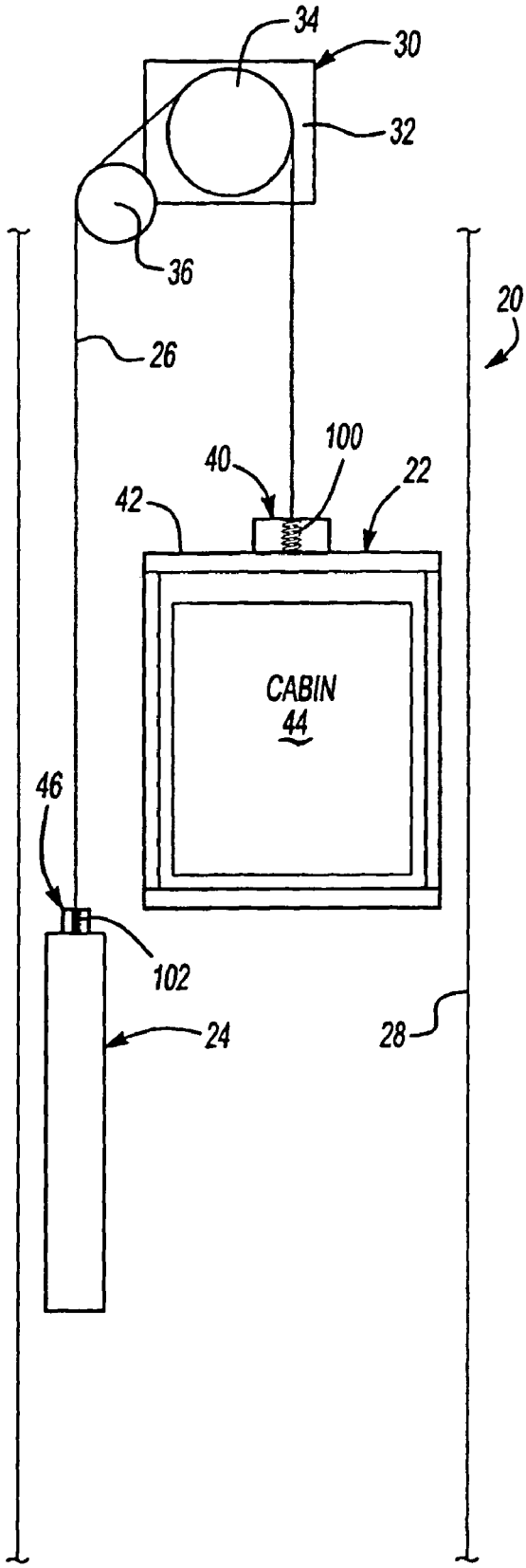
FIG. 9 schematically illustrates another embodiment.

In another example, as shown schematically in FIG. 9, the first biasing member 100 is associated with the termination 40 and the second biasing member 102 is associated with the termination 42. In this example, the first and second biasing members are not acting on opposite sides of a single support member. The two biasing members still operate responsive to tension forces as the examples described above. This embodiment physically separates the first and second biasing functions into different, remote locations within the elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a car;

a counterweight;

a load bearing member supporting the car and the counterweight such that the car moves in one direction and the counterweight moves in an opposite direction; and a termination associated with at least one end of the load bearing member, at least a portion of the termination moving against a first bias of the termination responsive to a tension on the load bearing member that is below a selected threshold and moving against a second, passive bias of the termination responsive to a tension that exceeds the threshold.

2. The system of claim 1, wherein the termination includes a terminating member and a support member and wherein the terminating member moves relative to the support member responsive to the tension below the threshold and wherein the support member moves with the terminating member when the tension exceeds the threshold.

3. The system of claim 2, including a damper that resists movement of the support member and wherein the damper at least partially absorbs the tension.

4. The system of claim 3, wherein the damper comprises at least one of a mechanical spring, an air spring or a pressurized actuator.

5. The system of claim 3, wherein the damper is preloaded a selected amount such that the damper prevents movement of the support member when the tension on the load bearing member is less than the selected threshold.

6. The system of claim 2, wherein the terminating member and the support member are moveable relative to a stationary surface and wherein the termination includes a tension member near an end of the terminating member that is distal from the load bearing member between the distal end and the support member, the tension member biasing the distal end away from the support member and a damper on an opposite side of the support member between the support member and the stationary surface, the damper biasing the support member away from the stationary surface.

7. The system of claim 6, wherein the tension member comprises a spring and the damper comprises at least one of a mechanical spring, an air spring, a pneumatic actuator or a hydraulic actuator.

8. The system of claim 7, wherein the support member comprises a plank and including a guide structure fixed relative to the stationary surface, the guide structure supports the plank such that the plank is moveable toward the stationary surface when the tension exceeds the threshold.

9. The system of claim 1, wherein the termination is supported for movement with the car.

10. The system of claim 1, wherein the termination is supported for movement with the counterweight.

11. The system of claim 1, including a machine that causes selective movement of the car and wherein the termination is in a fixed position relative to the machine.

12. The system of claim 1, including a first biasing member that provides the first bias and a second biasing member that provides the second bias and is located remote from the first biasing member.

13. A hitch device for securing an end of a load bearing member in an elevator system, comprising:

a terminating member that is adapted to be secured to a load bearing member;

a support member associated with the terminating member;

a first biasing member acting against one side of the support member to bias one end of the terminating member away from the support member; and a second, passive biasing member acting against an opposite side of the support member, the second biasing member being adapted to bias the support member away from a selected stationary surface;

a guide structure that guides the support member for selective movement against the bias of the second biasing member, the guide structure including a stationary surface against which the second biasing member acts such that the support member is selectively moveable relative to the guide structure, wherein the terminating member is moveable relative to the guide structure responsive to a first force that opposes the bias of the first biasing member and the support member is moveable with the terminating member against the bias of the second biasing member responsive to a second, greater force.

14. A hitch device for securing an end of a load bearing member in an elevator system, comprising:

a terminating member that is adapted to be secured to a load bearing member;

a support member associated with the terminating member;

a first biasing member acting against one side of the support member to bias one end of the terminating member away from the support member; and a second, passive biasing member acting against an opposite side of the support member, the second biasing member being adapted to bias the support member away from a selected stationary surface wherein the first biasing member has a first stiffness and the second biasing member has a second, lower stiffness.

* * * * *